US007790241B2

(12) United States Patent
Kim et al.

(10) Patent No.: US 7,790,241 B2
(45) Date of Patent: Sep. 7, 2010

(54) STEEL TUBE HAVING IMPROVED CORROSION-RESISTANCE AND METHOD FOR MANUFACTURING THE SAME

(75) Inventors: Gi Hyeoug Kim, Pyongtaek (KR); Sun Chang Kim, Pyongtaek (KR); Jae Pyeong Sim, Pyongtaek (KR)

(73) Assignee: Korea Bundy Co., Ltd., Pyongtaek (KR)

( * ) Notice: Subject to any disclaimer, the term of this patent is extended or adjusted under 35 U.S.C. 154(b) by 1100 days.

(21) Appl. No.: 11/428,408

(22) Filed: Jul. 3, 2006

(65) Prior Publication Data

US 2007/0054061 A1 Mar. 8, 2007

(30) Foreign Application Priority Data

Sep. 2, 2005 (KR) ..... 10-2005-0081691

(51) Int. Cl.
*B05D 1/18* (2006.01)

(52) U.S. Cl. ..... 427/436; 427/431; 427/329; 427/314; 427/320; 427/321

(58) Field of Classification Search ..... 138/138, 138/141, 143, DIG. 7; 428/36.91, 36.9, 624, 428/626, 650, 655, 658, 659, 681, 34.1, 35.8; 427/436, 431, 329, 314, 320, 321
See application file for complete search history.

(56) References Cited

U.S. PATENT DOCUMENTS 6,003,562 A * 12/1999 Iorio et al. ..... 138/138
6,143,364 A * 11/2000 Nakamori et al. ..... 427/310

* cited by examiner

*Primary Examiner*—Michael C Miggins
(74) *Attorney, Agent, or Firm*—Nixon Peabody LLP; Jeffrey L. Costellia

(57) ABSTRACT

Disclosed is a steel tube with superior corrosion-resistance treated with plating and a manufacturing method of the same. The manufacturing method of the steel tube includes the steps of: preheating a steel tube formed through a milling process; maintaining the temperature of the preheated steel tube above a predetermined temperature, and creating a reduction atmosphere; melting an Al—Zn alloy containing 55 wt % of aluminum and 43.4-44.9 wt. % of zinc, and plating the molten alloy over the surface of the steel tube; cooling the steel tube; and coating the surface of the steel tube with a resin.

8 Claims, 5 Drawing Sheets

STEEL TUBE HAVING IMPROVED CORROSION-RESISTANCE AND METHOD FOR MANUFACTURING THE SAME

This application claims priority under 35 U.S.C. §119 of Korean patent application no. 10-2005-0081692 filed Sep. 2, 2005.

TECHNICAL FIELD

The present invention relates to a method for manufacturing a steel tube, and more particularly to a steel tube that is surface treated for providing improved corrosion-resistance and a method for manufacturing the same.

BACKGROUND ART

In general, there are two types of methods for manufacturing a steel tube: an injection method and a method by using a steel plate. Since the injection method increases the cost of manufacture, many choose to process a steel plate into a tube.

Particularly, a steel tube obtained through the latter method is called an electric weld tube since a steel plate is transformed to a tube and its contacts are welded through electric resistance welding.

In effect, the method used for manufacturing such electric weld tube is now used in a wide range of applications in both large bore steel tubes and small bore steel tubes. Especially, small bore steel tubes are broadly used as a condenser for cooler equipment such as refrigerators or a hydraulic brake line, in which high durability and high reliability are required. Therefore, the small bore steel tube must be carefully managed from its manufacturing process.

In this same context, studies on more effective surface treatment techniques are in progress to prevent the corrosion on the surface of a small bore steel tube.

DISCLOSURE

Technical Problem

Therefore, the present invention has been made in view of the above problems, and it is an object of the present invention to provide a surface treated steel tube for increasing corrosion-resistance and a method for manufacturing the same.

Technical Solution

In accordance with an aspect of the present invention, the above and other objects can be accomplished by the provision of a method for manufacturing a steel tube with superior corrosion-resistance, the method including: a first step for preheating a steel tube formed through a milling process; a second step for maintaining the temperature of the preheated steel tube above a predetermined temperature, and creating a reduction atmosphere; a third step for melting an Al—Zn alloy containing 55 wt % of aluminum and 43.4-44.9 wt. % of zinc, and plating the molten alloy over the surface of the steel tube; a fourth step for cooling the steel tube; and a fifth step for coating the surface of the steel tube with a resin.

Preferably, the alloy further comprises 0.1-1.6 wt % of silicon. And, in the third step, the plating process is carried out while the steep tube passes vertically upwardly through a plating part storing the molten alloy, and gas is sprayed toward the steel tube so as to control the thickness of the alloy plating.

Preferably, a pressure greater than atmospheric pressure is applied to the bottom of the plating part by means of a pressure control unit, so as to prevent the leakage of the molten alloy in a downward direction between the steel tube and the plating part.

Preferably, in the second step, the reduction atmosphere is created by injecting hydrogen-nitrogen mixed gas around the steel tube.

Preferably, the fourth step includes the sub-steps of: performing air blasting on the plated steel tube; and quenching the steel tube using cold water. Moreover, a chromating (III) process is performed as pretreatment of the fifth step.

Preferably, in the fifth step, the surface of the steel tube is coated with a colorless nylon resin.

In accordance with another aspect of the present invention, there is provided a steel tube with superior corrosion-resistance including: a hollow steel tube allowing a fluid to run therein; and an Al—Zn alloy plating layer containing 55 wt % of aluminum and 43.4-44.9 wt % of zinc for coating the surface of the steel tube.

Preferably, the alloy further comprises 0.1-1.6 wt % of silicon.

Preferably, the surface of the plating layer is treated with chromium (III).

Preferably, the surface of the plating layer is coated with a nylon resin.

In accordance with another aspect of the present invention, there is provided an apparatus for manufacturing a steel tube with superior corrosion-resistance, in which the apparatus includes: a preheating apparatus for preheating a steel tube formed through a milling process; a pre-treating apparatus for maintaining the temperature of the preheated steel tube above a predetermined temperature, and creating a reduction atmosphere; a plating apparatus comprised of a heater used as a heating source for melting an Al—Zn alloy, and a plating part which is disposed at the path the steel tube passes through and which has a port for storing the molten alloy to be plated over the surface of the steel tube; and a resin coating apparatus for coating the outer surface of the plated steel tube with a synthetic resin.

Preferably, the path the steel tube passes through is disposed substantially vertically, and an upper and a lower guide roller for guiding the traveling of the steel tube are installed at the upper and lower ends of the vertical path.

Preferably, the apparatus further includes: a pressure control unit, which is installed at the bottom of the plating part and which provides a pressure greater than atmospheric pressure so as to prevent the leakage of the molten alloy in the downward direction between the steel tube and the plating part.

Moreover, the apparatus further includes: an upper nozzle apparatus, which is disposed at the upper portion of the plating part and which sprays gas to adjust the alloy plating thickness on the steel tube.

Preferably, the apparatus further includes: a level block, which is selectively inserted into the molten alloy to adjust the level of the molten alloy.

Preferably, the pre-treating apparatus includes: at least one tube, of which surface is warmed up and through which the steel tube passes; a ceramic heater mounted on the tube for generating heat; and a gas injection unit for injecting hydrogen-nitrogen mixed gas into the tube.

ADVANTAGEOUS EFFECTS

The steel tube manufactured by the above-described manufacturing method has a uniform surface and improved corrosion-resistance.

DESCRIPTION OF THE DRAWINGS

The above and other objects, features and other advantages of the present invention will be more clearly understood from the following detailed description taken in conjunction with the accompanying drawings, in which.

Figure 1:
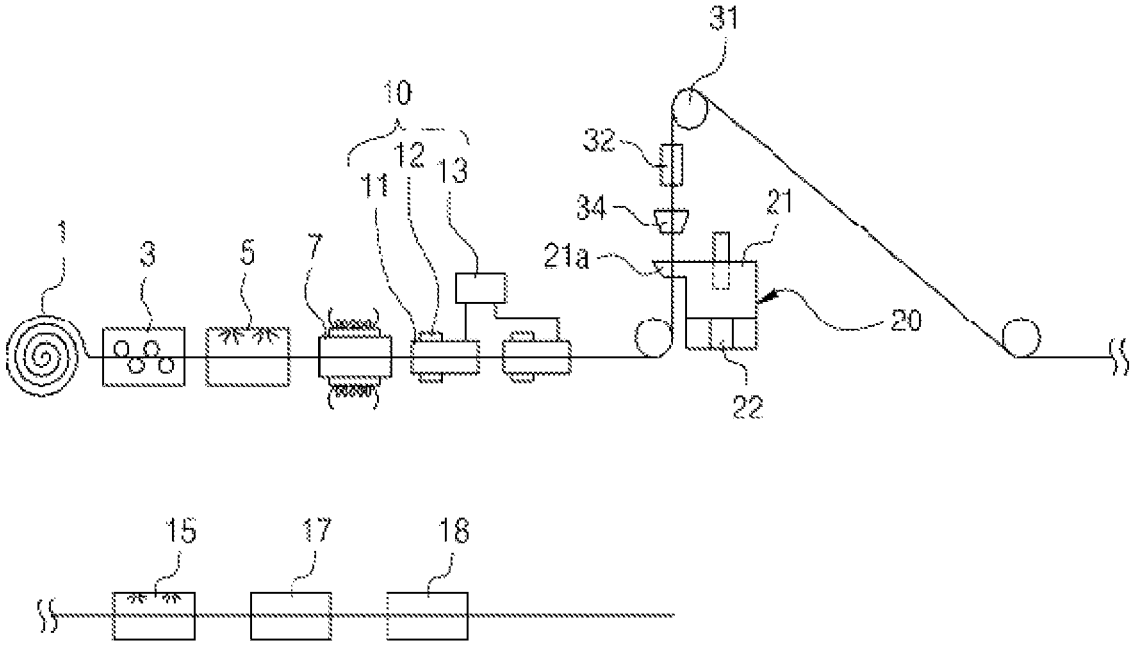
FIG. 1 is a schematic view showing the configuration of an apparatus for manufacturing a steel tube with superior corrosion-resistance, according to one embodiment of the present invention.

| * Description of Reference Numerals | |
|---|---|
| 1: steel tube | 7: preheating apparatus |
| 10: pre-treating apparatus | 15: cooling apparatus |
| 18: resin coating apparatus | 20: plating apparatus |
| 21: port | 21a: plating part |
| 21b: hole | 22: heater |
| 24: separator | 26: level block |
| 30: lower guide roller | 31: upper guide roller |
| 32: heating apparatus | 34: upper nozzle apparatus |

BEST MODE

A preferred embodiment of the present invention is explained hereinafter with accompanying drawings. In the following description, same drawing reference numerals are used for the same elements even in different drawings. Also, well-known functions or constructions are not described in detail since they would obscure the invention in unnecessary detail.

With reference to accompanying drawings, the following will now describe a steel tube with superior corrosion-resistance and a method for manufacturing the same according to a preferred embodiment of the present invention.

FIG. 1 is a schematic view showing the configuration of an apparatus for manufacturing a steel tube with superior corrosion-resistance, according to one embodiment of the present invention.

As shown in FIG. 1, a steel tube is first formed in coil shape by a coiler through a milling process before it is taken in the steel tube manufacturing apparatus of the present invention. That is, the milling process is carried out in a separate line.

The steel tube 1 brought in the steel tube manufacturing apparatus is straightened or uncoiled by an uncoiler 3, and the surface of the steel tube 1 is chemically treated in a chemical treatment apparatus 5 with a solution containing various kinds of acids or surfactants. Through this process, foreign substances on the surface of the steel tube can be removed. Following the chemical treatment, oxidated substances attached to the surface of the steel tube are physically removed through high-speed rotation of a wire brush for example. Later, the surface of the steel tube is cleansed by water and air.

Then, the steel tube 1 passes through an apparatus for manufacturing a steel tube excellent in corrosion-resistance, in which the apparatus is constituted by a preheating apparatus 7, a pre-treating apparatus 10, a plating apparatus 20 and a resin coating apparatus 18.

In detail, the preheating apparatus 7 preheats the steel tube 1 having passed through the milling process. To this end, the preheating apparatus 7 preheats the steel tube to approximately 600° C. or higher using an induction heater. Once preheated, the steel tube becomes a flexible state and its surface is heated ready for pre-treatment or plating.

The pre-treating apparatus 10 maintains the temperature of the preheated steel tube 1 higher than a predetermined temperature, and creates a reduction atmosphere. To this end, the pre-treating apparatus 1 includes at least one tube 11, a ceramic heater 12, and a gas injection unit 13. Desirably, the tubes 11 are arrayed in a line at regular intervals.

In detail, the surface of each tube 11 is kept warm, and the tubes 11 are arrayed in a manner that the steel tube 1 passes through their inside. An exothermic ceramic heater 12 is installed on the circumferential surface of the tube 11 to ensure that the preheated steel tube is maintained at a higher temperature than the predetermined temperature. In addition, the gas injection unit 13 injects hydrogen-nitrogen mixed gas into the tube 11 to create a reduction atmosphere.

Desirably, the concentration of hydrogen gas, which is a reducing gas, in the hydrogen-nitrogen mixed gas ranges 5-25%, and the mixed gas is injected approximately three times as much of the internal volume of the tube 11 at atmospheric pressure. The creation of a reduction atmosphere prevents the surface of the heated steel tube from getting easily oxidated to black, and helps the plating process (to be described) performed more stably.

The plating apparatus 20 is for plating the surface of the steel tube 1 with a corrosion resistant alloy. Desirably, the plating apparatus 20 includes a heater 22 and a port 21 for storing a molten alloy.

Figure 2:
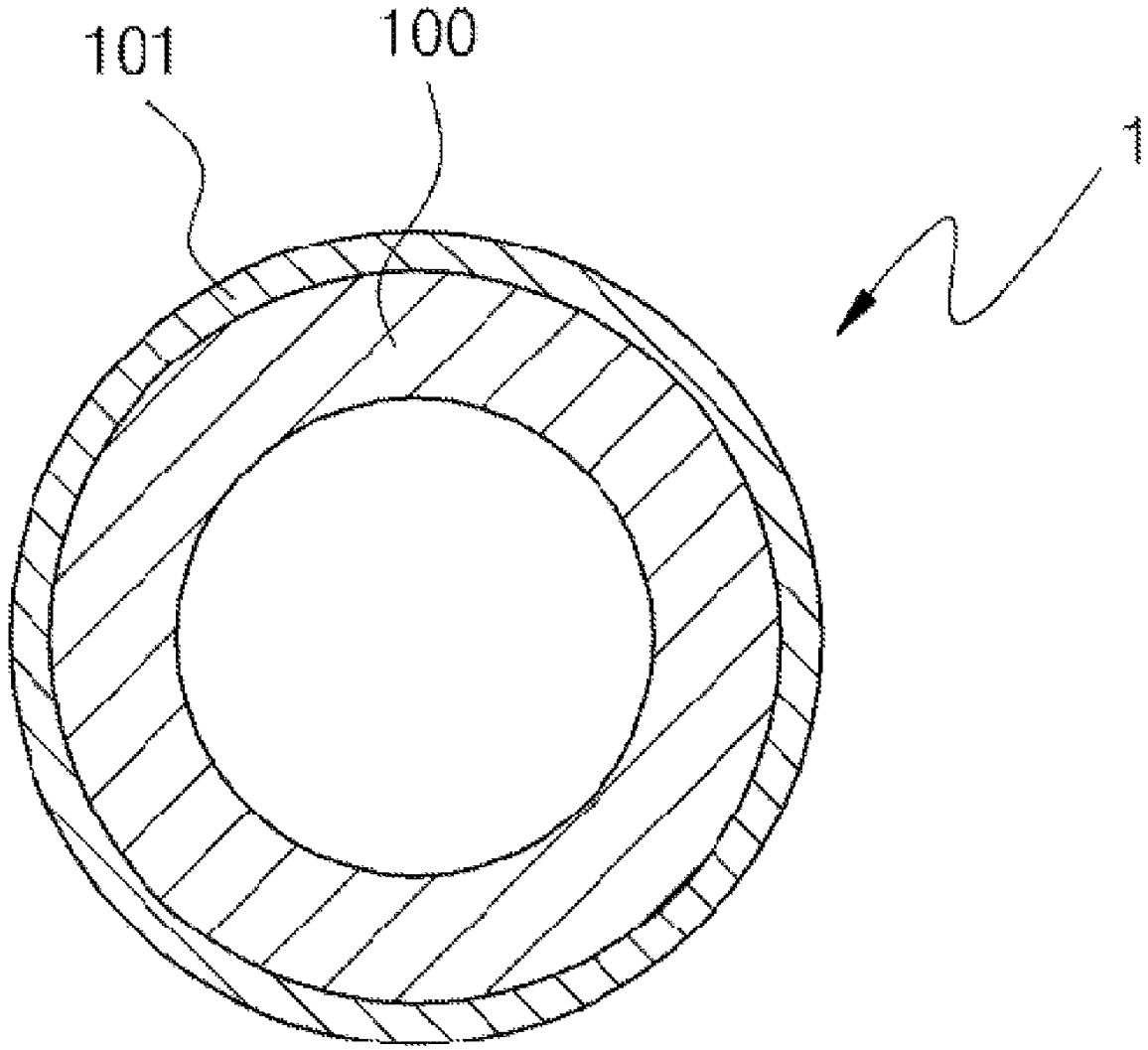
FIG. 2 is a cross-sectional view of a steel tube with superior corrosion-resistance, according to one embodiment of the present invention.

FIG. 2 is a cross-sectional view of a steel tube with superior corrosion-resistance according to one embodiment of the present invention.

As shown in FIG. 2, an alloy plating layer 101 is formed on the surface of the steel tube 100. The alloy plating layer 101 contains 55 wt % of aluminum and 43.4-44.9 wt % of zinc (this is called a SeAHLume alloy), which provides substantially increased corrosion resistance.

More desirably, the alloy further contains 0.1-1.6 wt % of silicon.

Referring back to FIG. 1, the heater 22 for melting the alloy is disposed below the port 21 serves as a heating source for melting the alloy through injection heating.

The port 21 is a vessel for storing the molten alloy, and has a protruded plating part 21*a* formed on the path the steel tube 11 passes through. That is, part of the molten alloy flows into the plating part 21*a* and is used for plating the surface of the steel tube 1 that moves along the hole formed in the plating part 21*a*.

Here, the path the steel tube 11 takes to pass through the plating part 21*a* is disposed vertically. That is, the steel tube 11 moves vertically between an upper guide roller 31 and a lower guide roller 30. This constitution allows the gravity to help the plating process for prevention of asymmetric plating, and ensures that a uniform plating layer is formed in a circumferential direction.

After rising vertically, the steel tube 1 is descended at an angle of predetermined degrees by the upper guide roller 31 for the next process. When the steel tube 1 arrives at a horizontal path again, it is cooled by an air cooling and water cooling apparatus 15. This cooling process involves air blasting and water spray quenching onto the surface of the steel tube.

Meanwhile, for prevention of the discoloring (blackening and whitening) phenomenon on the surface of the steel tube plated with the Al—Zn alloy after the cooling process and for increasing the adhesiveness of a resin layer (to be described), a chromating apparatus 17 supplies chromium (III) to the surface of the steel tube for 5 seconds, more preferably, less than 1 second.

Next, the resin coating apparatus 18 coats the surface of the plated steel tube with a synthetic resin. Here, the synthetic resin includes colorless nano-resins, more preferably, nylon resins.

Figure 3:
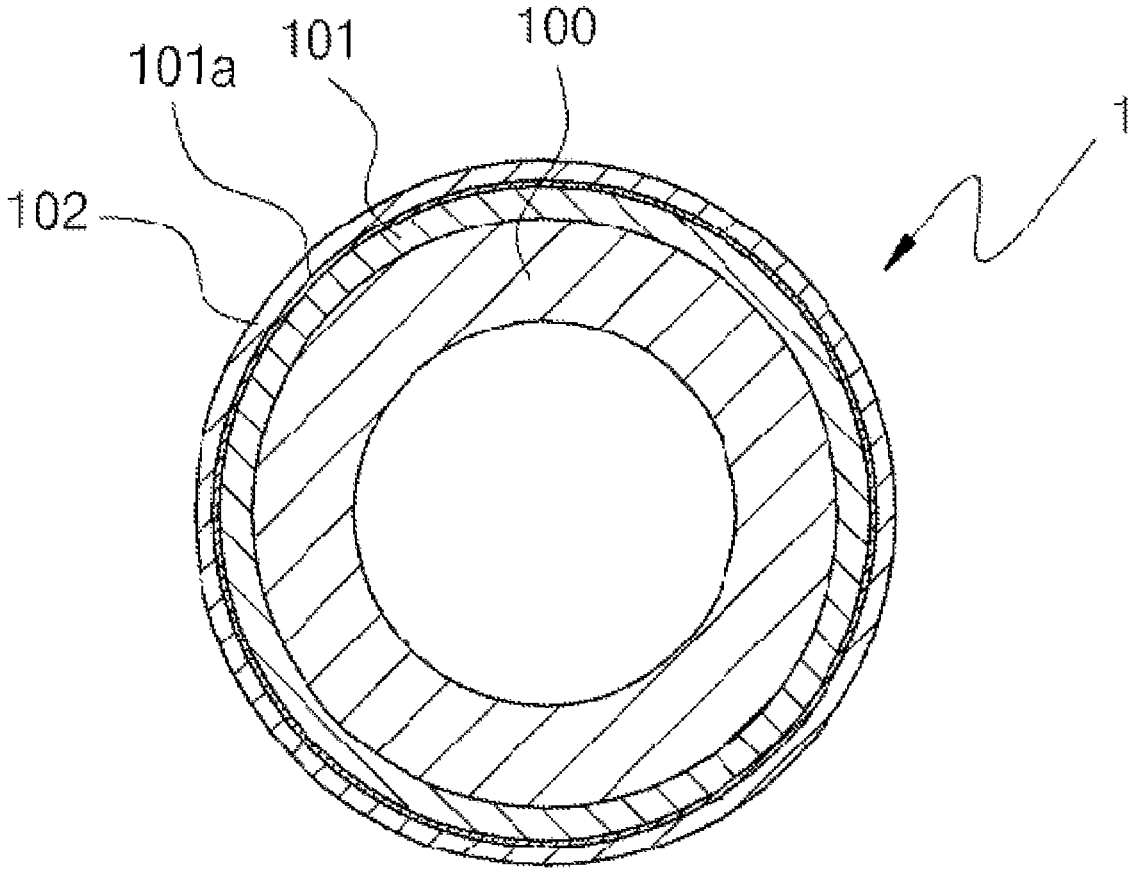
FIG. 3 is a cross-sectional view of a steel tube with superior corrosion-resistance, according to another embodiment of the present invention.

FIG. 3 is a cross-sectional view of a steel tube with superior corrosion-resistance, according to another embodiment of the present invention.

As shown in FIG. 3, a chromium (III) treated layer 101*a* is formed on the surface of the plating layer 101. Also, a coating layer 102 of nylon resin is formed on the surface of the chromate treated layer 101*a*. Both layers serve to improve corrosion-resistance of the steel tube 100.

Thusly manufactured steel tube through the above-described apparatuses is formed in a coil shape for the subsequent process.

Figure 4:
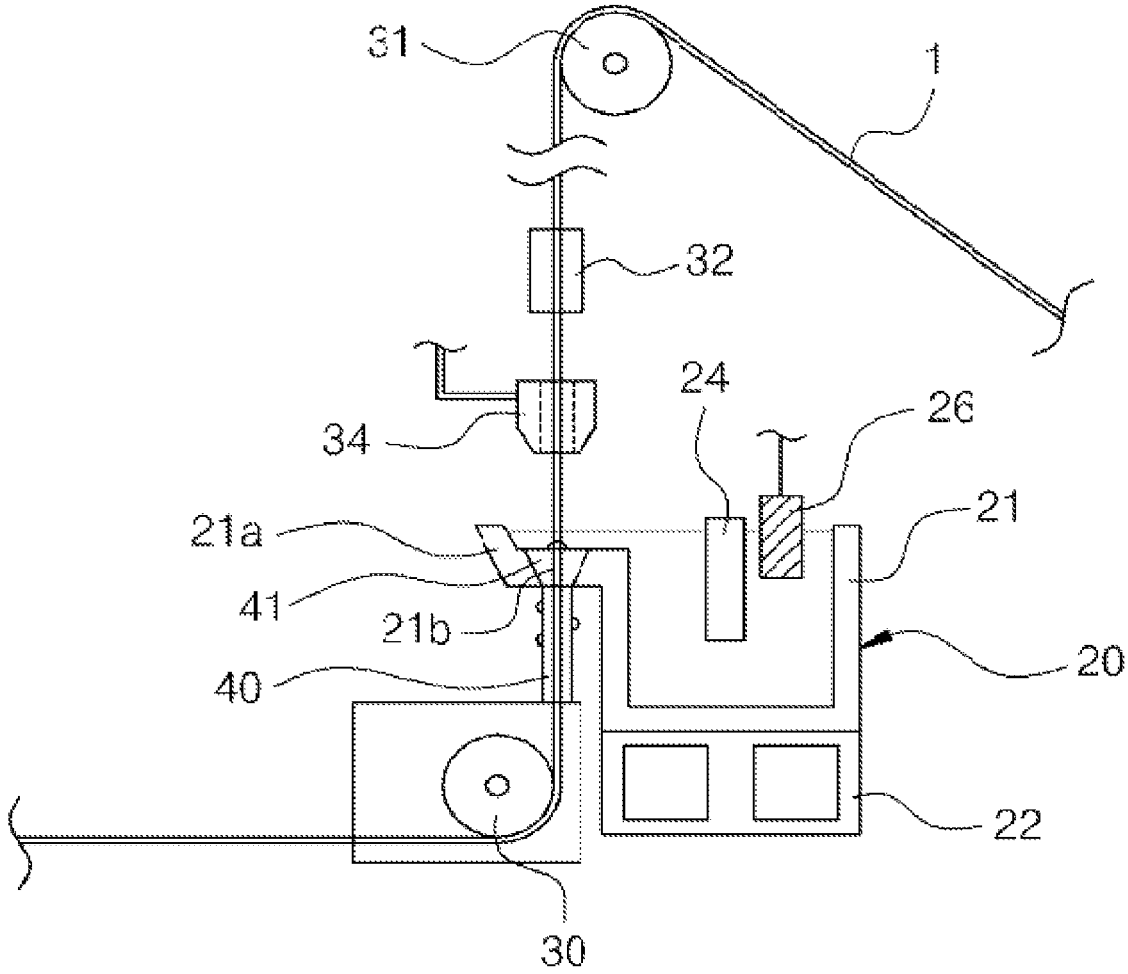
FIG. 4 is a cross-sectional view showing the configuration of a plating apparatus, according to one embodiment of the present invention.

FIG. 4 illustrates a plating apparatus according to one embodiment of the present invention. The following will now describe in detail the constitution of the plating apparatus with reference to FIG. 4.

As shown in the drawing, an induction heater 22 is disposed below the port 21, and a plating part 21*a* is protrusively formed on one side of the port 21.

The path of the steel tube 1 passing through the plating part 21*a* is disposed vertically, and an upper guide roller 31 and a lower guide roller 30 are installed at the upper end and the lower end of the vertical path, respectively, to guide the traveling of the steel tube.

Referring to FIG. 4, after the steel tube goes into the lower guide roller 30 along the horizontal direction over the ground surface, it is bent and then travels in the substantially vertical direction. The lower guide roller 30 is surrounded by a case, and an auxiliary tool for adjusting the (radical) clearance caused by the difference in the outer diameter of the steel tube is installed inside the case.

As the steel tube 1 passes the plating part, its surface is plated with an Al—Zn alloy (55 wt % of aluminum and 43.4-44.9 wt % of zinc). Desirably, the alloy further contains 0.1-1.6 wt % of silicon. Here, although the plating part 21*a* does not always have a molten alloy, a level block 26 that selectively enters the port 21 controls the level of a molten alloy to be flown into the plating part 21*a*.

In detail, a separator 24 for defining an upper space is installed inside the port 21, and the level block 26 is vertically movably mounted on one side of the separator 24. The separator 24 prevents the fluctuation of the level of a molten alloy around the plating part 21 due to the vertical movement of the level block 26. For instance, when the level block 26 descends and sinks in a molten alloy, the level of the molten alloy increases and the alloy flows into the plating parts. On the other hand, when the level block 26 ascends, the level of the molten alloy decreases and no alloy is supplied to the plating part 21*a*.

Moreover, a hole 21*b* through which the steel tube 1 passes is formed in the under surface of the plating part 21*a*, and a pressure control unit is further installed to prevent the leakage of the molten alloy through the hole 21*b* in the downward direction. The pressure control unit is constituted by a lower nozzle apparatus 41 and a guide pipe 40.

The guide pipe 40 is connected to the case surrounding the lower guide roller 30, and an inert gas such as nitrogen is fed into the guide pipe 40 to maintain a 0.1-0.3 bar high-pressure state therein. Also, the upper end of the guide pipe 40 communicates with the lower nozzle apparatus 41, making the lower nozzle apparatus 41 in high-pressure state. In this manner, the molten alloy flown into the plating part 21*a* is not easily leaked downward.

Therefore, by controlling the internal pressure of the pressure control unit including the guide pipe 40 and the lower nozzle apparatus 41, it becomes possible to uniformly plate the molten alloy on the surface of the steel tube that passes through the plating part 21 and travels in the vertical direction, and to prevent the leakage of the alloy in the downward direction.

A guide nozzle is formed at the upper and lower portions of the lower nozzle apparatus 41, respectively. This guide nozzle can be replaced if the outer diameter of a steel tube is changed.

Since the steel tube 1 moves vertically upwardly in the same direction as gravity, the alloy can be uniformly plated over the surface of the steel tube 1 as it passes through the plating part 21*a*. In other words, by the gravity the molten alloy that is plated on the surface of the steel tube 1 flows to one side and therefore, the thickness of plating on the surface of the steel tube is not asymmetric but uniform.

In addition, an upper nozzle apparatus 34 for spraying air or other mixed gas toward the steel tube is installed at the upper side of the plating part 21*a*. This upper nozzle apparatus 34 may have a constitution that enables to provide a very small amount of hydrogen gas to the steel tube and cause a flame therein for antioxidation. Also, the upper nozzle apparatus 34 may be used for blasting an inert gas such as nitrogen toward the steel tube 1 to adjust the thickness of the alloy plating used for the steel tube.

Meanwhile, the steel tube 1 having passed through the plating part 21*a* keeps moving vertically upwardly about 20 m further. At least one tube-shaped cooling apparatus 32 encompassing the steep tube is disposed at the traveling path of the steel tube 1. This tube-shaped cooling apparatus 32 provides an air blast for cooling the surface of the steel tube 1 below the predetermined temperature.

Moreover, the upper guide roller 31 is disposed at the upper end of the traveling path of the steel tube 1. In result, the steel tube 1 is bent by the upper guide roller 31 at an angle of about 30 degrees, and moves to the next cooling apparatus. The subsequent processes from here are same as the ones described before referring to FIG. 1.

The following will now explain a method for manufacturing the steel tube with superior corrosion-resistance, according to a preferred embodiment of the present invention.

Figure 5:
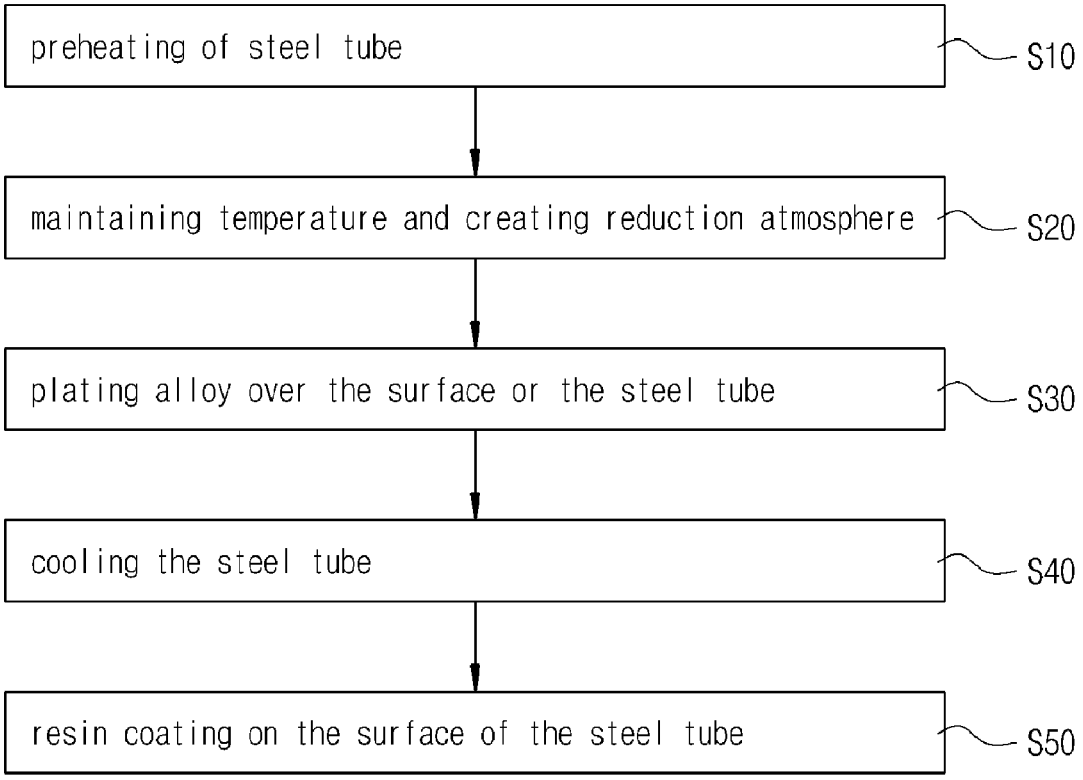
FIG. 5 is a flow chart explaining a method for manufacturing a steel tube with superior corrosion-resistance, according to one embodiment of the present invention.

FIG. 5 is a flow chart explaining the manufacturing method of the steel tube with superior corrosion-resistance.

As described in FIG. 5, a steel tube formed through a milling process is preheated (S10). Through this step, the surface of the steel tube becomes sufficiently flexible to be plated with an alloy. Desirably, the steep tube is preheated to a temperature higher than 600° C.

Next, a reduction atmosphere is created while the temperature of the preheated steel tube is being maintained above the predetermined temperature (S20). The reduction atmosphere can be created by injecting hydrogen-nitrogen mixed gas around the steel tube.

For plating, 55 wt % of aluminum and 43-45 wt % of zinc alloy is melted, and the molten Al—Zn alloy is plated over the surface of the steel tube (S30). Desirably, the alloy further contains 0.1-1.6 wt % silicon.

The Al—Zn alloy with such mixing ratio provides excellent corrosion-resistance to the steel tube. The steel tube is plated as it passes vertically upwardly through the port storing the molten alloy. While the steel tube passes through the plating part, the pressure control unit installed at the bottom of the plating part applies a pressure greater than the atmospheric pressure to prevent the leakage of the molten alloy in the downward direction.

And, once the steel tube passed through the port, gas is sprayed toward the steep tube to adjust the thickness of alloy plating on the surface of the steel tube. Through this process, the thickness of alloy plating on the surface of the steel tube is made uniform.

As described above, the vertical path of the steel tube is guided by the upper and lower guide rollers.

Next, the surface of the alloy plated steel tube is coated with a resin (S50). Desirably, a colorless nano-resin is used for coating the surface of the steel tube. More desirably, the resin contains a nylon resin.

Before the coating process, the steel tube should be cooled below the predetermined temperature. To this end, a cooling process (S40) involving air blasting and cold water spray quenching is carried out.

Moreover, a chromating (III) process is performed in advance as part of the pretreatment for coating the steel tube with the resin. The chromating process prevents discoloring of the steel tube and provides good appearance to the steel tube.

Since the surface of the steel tube is plated with the SeAHLume alloy and is coated with the nylon resin, corrosion-resistance of the steel tube is substantially increased. Therefore, when applied to a machine like a heat exchanger, it can guarantee a very stable operation.

INDUSTRIAL APPLICABILITY

The steel tube with superior corrosion-resistance and its manufacturing method of the present invention yield the following advantages.

First, the use of an alloy plating layer containing 55 wt % of aluminum and 43.4-44.9 wt % of zinc substantially increases corrosion-resistance of the steel tube.

Second, since the plating process is performed as the steel tube travels substantially vertically, the Al—Zn alloy can be uniformly plated over the surface of the steel tube along its circumferential direction.

Third, by spraying an inert gas toward the steel tube through the upper nozzle apparatus, one can easily control the thickness of the alloy plating for the steel tube.

Fourth, since the plated surface of the steel tube is coated with a resin additionally, corrosion-resistance of the steel tube is increased and one can manufacture steel tube products having good appearance.

Fourth, compared with the chromate (V) treatment, the chromate (III) treatment is environmentally-friendly and improves the adhesives of the resin coating layer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for manufacturing a steel tube with superior corrosion-resistance, the method comprising the steps of:

preheating a steel tube formed through a milling process;

maintaining the temperature of the preheated steel tube above a predetermined temperature, and creating a reduction atmosphere;

plating the molten alloy over the surface of the steel tube by melting an Al—Zn alloy containing 55 wt % of aluminum and 43.4-44.9 wt. % of zinc, and inserting a level block into the molten alloy to raise the level of the alloy, wherein fluctuation of the molten alloy around a plating part is prevented by a separator, and the level is raised, so that the alloy is introduced in the plating part;

cooling the steel tube; and coating the surface of the steel tube with a resin.

2. The method of claim 1, wherein the alloy further comprises 0.1-1.6 wt % of silicon.

3. The method of claim 1, wherein, in the maintaining step, the reduction atmosphere is created by injecting hydrogen-nitrogen mixed gas around the steel tube.

4. The method of claim 1, wherein the cooling step comprises the sub-steps of:

performing air blasting on the plated steel tube; and quenching the steel tube using cold water.

5. The method of claim 1, wherein a chromating (III) process is performed as pretreatment of the fifth step.

6. The method of claim 1, wherein, in the coating step, the surface of the steel tube is coated with a colorless nylon resin.

7. The method of claim 1, wherein, in the melting step, the plating process is carried out while the steep tube passes vertically upwardly through a plating part storing the molten alloy, and gas is sprayed toward the steel tube so as to control the thickness of the alloy plating.

8. The method of claim 7, wherein a pressure greater than atmospheric pressure is applied to the bottom of the plating part by means of a pressure control unit, so as to prevent the leakage of the molten alloy in a downward direction between the steel tube and the plating part.

* * * * *